United States Patent [19]

Martin et al.

[11] 4,401,449

[45] Aug. 30, 1983

[54] SLUSH ICE MAKER

[75] Inventors: Walter H. Martin; George C. Briley, both of San Antonio, Tex.

[73] Assignee: Refrigeration Engineering Corporation, San Antonio, Tex.

[21] Appl. No.: 373,054

[22] Filed: Apr. 29, 1982

[51] Int. Cl.[3] ..... F25C 1/00

[52] U.S. Cl. ..... 62/59; 62/66; 62/330; 62/340; 62/532

[58] Field of Search ..... 62/59, 66, 123, 330, 62/340, 532, 62

[56] References Cited

U.S. PATENT DOCUMENTS

| | | | |
|---|---|---|---|
| 1,930,570 | 10/1933 | Taylor | 62/347 |
| 3,004,395 | 10/1961 | Morris | 62/330 |
| 3,214,371 | 10/1965 | Tuwiner | 62/532 |
| 3,344,616 | 10/1967 | Owen | 62/123 X |
| 3,754,407 | 8/1973 | Tyree, Jr. | 62/62 X |
| 3,815,377 | 6/1974 | Tyree, Jr. | 62/62 |
| 3,922,878 | 12/1975 | Jalali | 62/330 X |
| 4,249,388 | 2/1981 | Burns | 62/330 X |

OTHER PUBLICATIONS

Process Fluid Chiller, Refrigeration Engineering Corporation, 1980.

Ingredient/Process Water Chiller, Refrigeration Engineering Corporation, 1979.

*Primary Examiner*—William E. Tapolcai

*Attorney, Agent, or Firm*—Watson, Cole, Grindle & Watson

[57] ABSTRACT

A slush ice maker includes a fluid chiller having water circulation tubes in which water flowing therethrough is deeply cooled to about 32° F., a water conduit system coupled with the chiller and including a high pressure pump for pumping water through the tubes at a pressure of about 2 to 4 atmospheres and at a velocity in excess of 9 ft. per second to effect the formation of ice crystals in the water so as to define the slush ice. The ice and water mixture is discharged into an ice accumulation tank maintained at atmospheric pressure so that the formation of ice crystals are enhanced when the pressure of the slush ice is reduced to atmospheric at the tank.

4 Claims, 2 Drawing Figures

SLUSH ICE MAKER

BACKGROUND OF THE INVENTION

This invention relates generally to an apparatus and method for making slush ice, and more particularly to a slush ice maker which incorporates the use of a fluid chiller of a shell and tube type heat exchanger.

Prior techniques for the making of slush ice are known to utilize a congealing approach for the formation of ice crystals as water is introduced into a refrigerated chamber against which the water congeals to form an ice layer after which additional water is used to form a slush ice mixture. And, scrapers may be provided for removing the ice layer before it is carried away by the additional water flow.

Such method utilized in the making of slush ice is not, however, without its disadvantages when considering the costly equipment and time normally required to carry out the ice making operation.

SUMMARY OF THE INVENTION

It is therefore an object of the present invention to provide a slush ice maker which avoids the congealing technique and which is not only of simple construction and operation but offers a highly effective and economical approach in the formation of ice crystals.

Another object of this invention is to provide such a slush ice maker which makes use of a fluid chiller of the shell and tube type heat exchanger in combination with a water conduit system for the pumping of water at a predetermined high pressure and high velocity through the fluid chiller in which the water is subcooled to approximately a freezing temperature for the formation of some ice crystals on the inside of the tubes, the ice and water mixture then discharging into an ice accumulation tank maintained at atmospheric pressure so that the formation of ice crystals is enhanced when the pressure of the ice crystals and water is reduced to atmospheric.

A further object of the present invention is to provide such a slush ice maker wherein the water is pumped through the fluid chiller at an elevated pressure of about 2 to 4 atmospheres and at a high velocity in excess of 9 ft. per second, the fluid chiller including an elongated shell containing water circulation tubes extending between opposed end walls of the shell, and pipe return bends located outwardly of the end walls interconnecting pairs of the tubes to define a continuous flow path between inletting and outletting tubes thereof.

Other objects, advantages and novel features of the invention will become more apparent from the following detailed description of the invention when taken in conjunction with the accompanying drawings.

DETAILED DESCRIPTION OF THE INVENTION

Figures 1, 2:
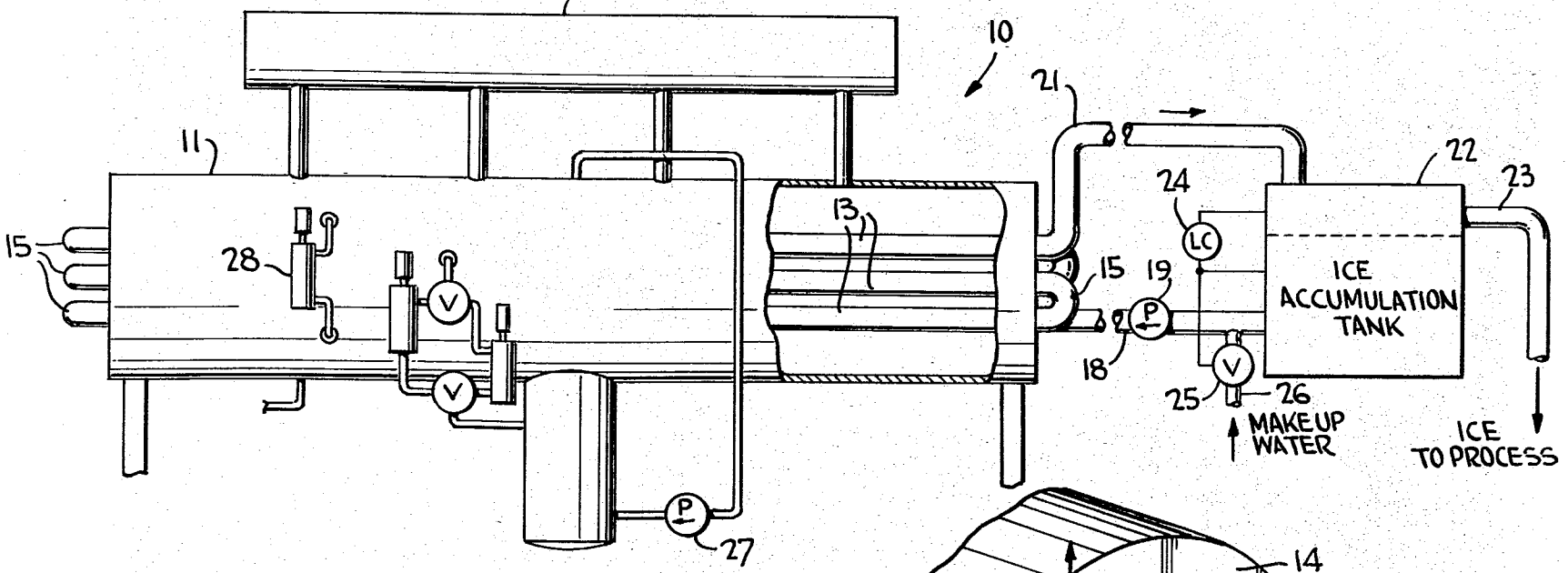
FIG. 1 is a side elevational view, showing the fluid chiller shell partly in section, of a slush ice maker according to the invention.
FIG. 2 is a perspective view at an enlarged scale of a typical end of the fluid chiller showing the pipe return bends.

Turning now to the drawings wherein like reference characters refer to like and corresponding parts throughout the several views, a slush ice making system of the invention includes a fluid chiller, generally designated 10, as including an elongated shell 11 having a surge drum 12 located above the chiller vessel and being of known construction and operation. The shell contains a plurality of water circulation tubes 13 of about 3½ inches in outer diameter and extending between opposite ends of the shell which are closed by walls 14. The chiller employs a refrigerant spray system to continually wet the outside of the ice making tubes 13 with refrigerant at a temperature approaching 32° F. This provides excellent heat transfer at high rates. Refrigerant level is maintained below the bottom of tubes 13 to prevent "freeze-up" during a power failure on inadvertent shut-down of the unit. And, the water pressure in the tubes is maintained higher than the refrigerant pressure to prevent possible leakage of refrigerant into the water/ice stream.

A plurality of pipe return bends 15 are located externally of shell 11 and are provided for interconnecting pairs of the tubes to define a continuous flow path between an inletting tube 16 and an outletting tube 17, these pipe return bends being designed to accommodate the higher operating pressure within the water circulation tubes.

A closed water conduit system is coupled to the fluid chiller and includes an inlet conduit 18 having a high pressure pump 19 for pumping a mixture of water and ice, or water alone, through the water circulation tubes via inletting tube 16. An outlet conduit 21 connected to outletting tube 17 discharges the mixture of water and ice formed in the chiller directly into the top end of an ice accumulation tank 22 maintained at atmospheric pressure. Slush ice is drawn off through conduit 23 to process or to its end use destination. And, depending on the level of slush and water in the tank, as determined by a level control 24, an inlet valve 25 to which the level control is operatively connected is opened to admit make-up water into the fluid conduit system via a conduit 26 connected to a water supply. Suitable means at the juncture between conduits 26 and 18 is provided for preventing the make-up water from entering the ice accumulation tank.

In operation, water is admitted into the fluid conduit system through open conduit 26 and is pumped through water circulation tubes 13 of the chiller at an elevated pressure of about 2 to 4 atmospheres and at a high velocity in excess of 9 ft. per second, up to about 12 or 13 ft. per second. The water is circulated through the chiller tubes at approximately 32° F., as controlled by the temperature of the refrigerant and some ice crystals are formed on the inside of the water circulation tubes by controlling the pressure and velocity of the water and the temperature of the refrigerant. The ice crystals are released or are caused to release by the velocity of the water within tubes 13, without the need for scraper blades. The pipe return bends 15 lying outwardly of end walls 14 of shell 11 function to accommodate the higher operating pressure within the chiller. These pipe return bends replace fluid distribution headers provided externally of the chiller casing of an earlier developed process fluid chiller which is similar to fluid chiller 10 in construction and operation except that it is designed to provide chilled water at 33° F., or higher temperature, to chill wine or beer and the like to a desired temperature all at a low mean temperature difference, with assurance that there will be no freeze-up. By contrast, water flowing through chiller 10 is deep-cooled to approximately 32° F. for carrying out the invention. A positive displacement pump 27 is designed to supply sufficient liquid ammonia to cover the entire tube surface within the chiller, and surge drum 12 is provided to assure that all liquid ammonia is eliminated from the suction vapors, thus eliminating the need for additional suction traps. The refrigerant controls normally include a level switch 28 and a solenoid valve with strainers, a hand expansion (throttle) valve and two stop valves. A dual release valve assembly is also included, as are a low temperature switch and a flow switch arranged to shut off the refrigerant pump and to close the refrigerant solenoid valve.

Upon discharge from the fluid chiller, the ice and water mixture is fed into ice accumulation tank 22 via conduit 21 whereupon the formation of ice crystals is further enhanced when the pressure of the ice crystals and water is reduced to atmospheric. Inlet conduit 18 is connected near the bottom of the tank so that a water and ice mixture may be recirculated therefrom by operation of pump 19 through fluid chiller and back into the ice accumulation tank until a predetermined ice and water balance is obtained as desired for the quality of slush ice intended. That slush ice may then be drawn off to process via conduit 23, and make-up water is admitted to inlet conduit 18, but not to the tank, through valve 25 which opens under the control of level control switch 24 depending on the level of the water and ice mixture in the tank. Pump 19 then circulates the water, and the water/ice mixture, for the formation of slush ice in the manner as aforedescribed.

From the foregoing, it can be seen that a system for the formation of slush ice is provided without reliance on ice congealing which is typical of prior art techniques. The unique approach taken by the invention includes subcooling the water under pressure and high velocity for the forming of ice crystals on the inside of the water circulation tubes in the fluid chiller under precisely controlled conditions of water velocity, pressure and refrigerant temperature. When the subcooled water, containing some ice crystals, is depressurized at the tank, further ice crystals are formed to form slush ice without the need for mixing with additional precooled water as previously required.

Obviously, many modifications and variations of the present invention are made possible in the light of the above teachings. It is therefore to be understood that within the scope of the appended claims the invention may be practiced than as specifically described.

What is claimed is:

1. An apparatus for making slush ice, comprising an elongated shell having closed end walls, a plurality of water circulation tubes lying parallel to the axis of said shell and extending between said end walls, pipe return bends located outwardly of said end walls and respectively interconnecting pairs of said tubes to define a continuous flow path between inletting and outletting ones of said tubes, a water inlet connected to said inletting tube and a water outlet connected to said outletting tube, a slush ice accumulation tank at said fluid outlet for collecting slush ice at atmospheric pressure, refrigeration means for cooling water circulating through said tubes at approximately a water freezing temperature, and a high pressure pump in said fluid inlet for pumping water through said tubes at an elevated pressure of about 2 to 4 atmospheres and at a high velocity in excess of 9 ft. per second, whereby ice crystals are formed in the water at the elevated pressure and at the high velocity and are enhanced when the pressure of the ice crystals and water is reduced to atmospheric in said tank.

2. An apparatus for making slush ice, comprising water chilling means including water circulation tubes in which water flowing therethrough is deeply cooled to about 32° F., a water conduit system interconnected with said chilling means and including a high pressure pump for pumping water through said tubes at a pressure of about 2 to 4 atmospheres and at a velocity in excess of 9 ft. per second to effect the formation of ice crystals in the water defining slush ice, an ice accumulation tank maintained at atmospheric pressure for the reception of the slush ice, the formation of ice crystals thereby being enhanced when the pressure of the slush ice is reduced to atmospheric at said tank.

3. The apparatus for making slush ice according to claim 2, wherein said water chilling means further includes an elongated shell having closed end walls, said tubes extending between said end walls, and pipe return bends lying outwardly of said end walls and interconnecting pairs of said tubes to define a continuous flow path between inletting and outletting ones of said tubes.

4. A method of making slush ice, comprising the steps of: pumping water through the circulation tubes of a shell and tube type heat exchanger at a pressure of about 2 to 4 atmospheres and at a rate in excess of 9 ft. per second; deep-cooling the water in the heat exchanger to about 32° F. to effect the formation of ice crystals on the inside of the tubes; releasing the ice crystals from the tubes by the water circulating therethrough to form a water and ice mixture; maintaining an ice accumulation tank at atmospheric pressure; and reducing the pressure of the water and ice mixture to atmospheric by discharging the mixture from the chiller directly into the tank for enhancing the formation of ice crystals in the mixture.

* * * * *